US008899861B2

(12) United States Patent
Faison

(10) Patent No.: US 8,899,861 B2
(45) Date of Patent: Dec. 2, 2014

(54) TOOTHBRUSH WITH INTERNAL TOOTHBRUSH DISPENSER

(76) Inventor: Ronald L. Faison, Evergreen, IL (US)

( * ) Notice: Subject to any disclaimer, the term of this patent is extended or adjusted under 35 U.S.C. 154(b) by 276 days.

(21) Appl. No.: 13/342,888

(22) Filed: Jan. 3, 2012

(65) Prior Publication Data

US 2012/0170967 A1 Jul. 5, 2012

Related U.S. Application Data

(60) Provisional application No. 61/460,445, filed on Jan. 3, 2011.

(51) Int. Cl.

| | |
|---|---|
| ***A46B 11/02*** | (2006.01) |
| ***A46B 9/04*** | (2006.01) |
| ***A46B 11/00*** | (2006.01) |

(52) U.S. Cl.

CPC ..... *A46B 9/04* (2013.01); *A46B 11/002* (2013.01); *A46B 11/0065* (2013.01)

USPC ..... 401/188 R; 401/272

(58) Field of Classification Search

USPC ..... 401/188 R, 270, 272, 273, 278, 282

See application file for complete search history.

(56) References Cited

U.S. PATENT DOCUMENTS

| | | | | |
|---|---|---|---|---|
| 3,910,706 | A | 10/1975 | Del Bon | |
| 3,937,235 | A | 2/1976 | Broughton | |
| 4,221,492 | A | 9/1980 | Boscardin | |
| 4,277,194 | A | 7/1981 | Smith | |
| 5,158,383 | A | 10/1992 | Glover | |
| 5,393,153 | A * | 2/1995 | Bouthillier et al. | 401/146 |
| 5,407,287 | A | 4/1995 | Braun | |
| 5,415,187 | A | 5/1995 | Heneveld | |
| 6,009,886 | A | 1/2000 | Labranche | |
| 6,039,489 | A | 3/2000 | Harman | |
| 6,142,694 | A | 11/2000 | Rivlin | |
| 6,206,600 | B1 * | 3/2001 | Rosenberg et al. | 401/272 |
| 6,609,848 | B1 | 8/2003 | Rosenberg | |
| 6,948,875 | B1 * | 9/2005 | Jang | 401/146 |

* cited by examiner

*Primary Examiner* — David Walczak

(74) *Attorney, Agent, or Firm* — Attentive Law; Paul Ratcliffe

(57) ABSTRACT

A toothbrush for dispensing toothpaste from a main body or removable cartridge to one or more openings proximate bristles on the toothpaste head. The toothbrush includes a main body which is adapted to receive a disposable cartridge, a brush head, a neck, and a pumping system. The neck and an adapter connect the head to the main body. The pumping system comprises a spring-loaded pump system for forcing toothpaste stored in the housing or disposable cartridge through a fluid passage way to the head. A piercing tube or straw is used to pierce the tight plastic seal of the disposable cartridge.

12 Claims, 6 Drawing Sheets

TOOTHBRUSH WITH INTERNAL TOOTHBRUSH DISPENSER

CROSS REFERENCE TO RELATED APPLICATION

This application claims the benefit of U.S. Provisional Application Ser. No. 61/460,445 filed Jan. 3, 2011, entitled "Pro Dent Max," the entirety of which is incorporated herein.

BACKGROUND OF THE INVENTION

1. Field of the Invention

The present invention relates to a novel toothbrush. More particularly, the present invention pertains to a toothbrush with a toothpaste compartment for dispensing toothpaste.

2. Description of the Related Art

The introduction of a toothbrush having an internal toothpaste compartment reduces the spread of household germs. The spread of germs is a major problem inside of bathrooms. Bathrooms hold many germs, from bodily fluids, fecal matter becoming airborne when the toilet is flushed, to saliva when human beings spit in the sink. People contend with bird flu, swine flu, common colds and many viruses such as H1N1, which has been deadly to children at an alarming rate.

The present invention solves the problem of transmission of household germs between multiple toothbrushes and a singular tube of toothpaste. In this invention, each toothbrush has its own self contained compartment that allows for the insertion of a disposable cartridge containing toothpaste and readily supplies the toothbrush with the toothpaste, as needed. By providing each toothbrush with its own supply of toothpaste in an internal compartment, this invention reduces the spread of germs between multiple toothbrushes that use a toothpaste tube. Accordingly, the present invention helps prevent the spread of these deadly germs and keeps us safer in our homes.

SUMMARY OF THE INVENTION

This summary is provided to introduce concepts in a simplified form that are further described in the detailed description of the invention. This summary is not intended to identify key or essential inventive concepts of the claimed subject.

The components of the invention are a toothbrush comprised of a main body, a head, and a neck. The neck connects the head to the main body. The main body comprises a housing for holding a replaceable disposable cartridge containing toothpaste. A window gage is shown along the outside of the body for displaying the level of toothpaste in the disposable cartridge. The main body also comprises a pump system for dispensing toothpaste from the disposable cartridge through the neck and out of the head of the toothbrush. The pump system has a spring and a pump lever based system for drawing toothpaste stored in the disposable cartridge through a straw or tube and up to the head of the toothbrush. The disposable cartridge has a hard plastic top with a small opening covered with a thin plastic pierceable seal to ensure that the toothpaste is not contaminated and to avoid the toothpaste from leaking excessively inside the housing. At the end of the tube or straw is a puncture piercing tip designed to pierce through the pierceable opening of the sealed top of the disposable cartridge. The pierceable opening aligns with the tube or straw with the piercing tip to allow the user to position the present invention horizontally without the toothpaste leaking out of the disposable cartridge.

More specifically, the present invention provides for a toothbrush that dispenses fluid material and comprises: (1) a removable toothbrush head having a front face where the front face has a plurality of bristles and at least one opening on the front face of the toothbrush head where the opening allows for fluid material to be dispensed proximate the plurality of bristles; (2) an adapter or chamber for receiving the removable toothbrush head; (3) a neck having a first end and a second end, where the first end is connected to the adapter and the second end engages a fluid pumping assembly; (4) a fluid pumping assembly; and (5) the main body comprising of an upper end with a pump assembly mating interface, an outer housing and a removable end cap. When fully assembled the toothbrush provides a fluid passage from the main housing through the pump tube and tube cap into the pump casing, through the neck and adapter to the at least one opening in the toothbrush head, where fluid within the main housing is pumped through the at least one small opening in the front end of the head by the fluid pump assembly.

The fluid pumping assembly comprises a pump cap, a pump casing, a pump spring, a pump tube, and a tube cap. The pump cap includes fastening means to attach the fluid pumping assembly to a main housing. The pump casing is fastened to the pump cap and is configured to receive the second end of the neck. The pump casing encompasses the pump spring and the tube cap. The pump casing also has a lower portion which engages the tube and has ridges for structural support. The lower portion of the pump case may comprise a tapered end with ridges that line the outer circumference of the tapered end of the pump case. The pump tube, wherein the first end of the pump tube is connected to the tube cap and a second end of the pump tube extends out of the pump casing and into the main housing, wherein the second end of the pump tube has a tip which may have a sharp end configured to pierce an opening in the fluid dispensing cartridge. The fluid pumping assembly of the present invention may be engaged by pushing the adapter or toothbrush head up and down or may be engaged by pushing a lever attached to the pumping assembly.

The pump cap is configured to mechanically fasten to the main body mating interface such that the pump assembly can be removed from the main housing. In addition, the end cap may comprise an inner surface configured to mechanically receive a removable fluid dispensing cartridge which contains one of liquid, gel, or paste for cleaning teeth. The end cap may include a threaded fastening design to mate with a threaded design, or may include a friction fit design to mate with the removable cartridge, or may include a compression clamp configured to mate with one or more ridges or indents on the removable cartridge. The outer surface of the end cap may be configured to mechanically receive or attach a dental floss holder.

These and other objects, features, and/or advantages may accrue from various aspects of embodiments of the present invention, as described in more detail below.

BRIEF DESCRIPTION OF THE DRAWINGS

The foregoing summary, as well as the following detailed description of the invention, is better understood when read in conjunction with the appended drawing. For the purpose of illustrating the invention, exemplary constructions of the invention are shown in the drawings. However, the invention is not limited to the specific methods and instrumentalities disclosed herein.

DETAILED DESCRIPTION OF EXEMPLARY EMBODIMENTS

Particular embodiments of the present invention will now be described in greater detail with reference to the figures.

Figure 1:
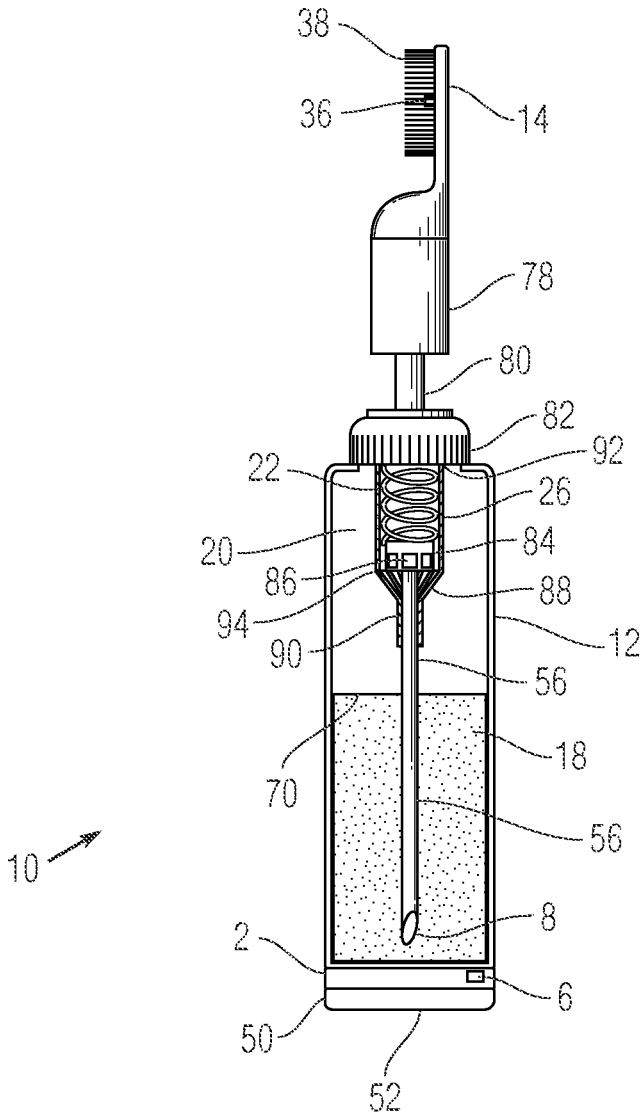
FIG. 1 illustrates the preferred embodiment of the toothbrush in accordance with the present invention.

The preferred embodiment of the present invention is illustrated in FIG. 1. As seen in FIG. 1, a toothbrush 10 comprises of a main body 12, a head 14, a neck 80, and a chamber 78, wherein the chamber connects the neck 80 and the head 14.

Threads line the bottom end of the head 14 and the top portion of the chamber 78 so that the head 14 can be easily screwed on and off of the chamber 78. This allows for the user to replace easily one head 14 with a new head 14. In alternative embodiments, the head 14 may be designed such that it snap-fits onto the chamber 78 or twists and locks onto the chamber 78.

The head 14 contains a passage that leads to a small opening 36 on the head 14 located near the bristles 38. This enables the toothpaste to flow from the chamber 78 onto the bristles 38. In an alternative embodiment, the head 14 consists of a passage that leads to multiple openings 36 so that the toothpaste may be evenly distributed on the head 14 and to the bristles 38 of the toothbrush 10.

The neck 80 acts as a passage between the spring-loaded pump 20 and the chamber 78 to allow for the toothpaste, liquid, or gel to flow from the cartridge 18 in the main body 12 onto the bristles 38. One end of the neck 80 is connected to the chamber 78 and the other end is connected to pump cap 82 and spring-loaded pump 20. The pump cap 82 may be mechanically attached or screwed onto the main body 12.

The spring-loaded pump system 20 comprises a spring 22, a tube cap 84, and a cylindrical passage 90 for forcing toothpaste stored in the disposable cartridge 18 to be dispensed onto the bristles 38 of the toothbrush head 14. The spring 22 is positioned or encapsulated in a case 26. The case 26 consists of a first end 94 and a second end 92, wherein the second end 92 is connected to the pump cap 82 and the first end 94 is connected to a cylindrical passage 90. The cylindrical passage 90 has a smaller diameter than the case 26, and is connected to a tube or straw 56 with a piercing tip 8.

The straw 56 extends from the cylindrical passage 90 into the disposable cartridge 18. The straw 56 allows the toothpaste or liquid to be drawing or travel from the disposable cartridge 18 to the spring-loaded pump 20. At the tip of the straw 56 is a puncture piercing tip 8, such that the pointed tip 8 is able to pierce through the plastic seal 49 on the cartridge top 70 of the disposable cartridge 18. The disposable cartridge 18 and piercing straw 56 are further described in FIG. 2.

A tube cap 84 resides within the pump case 26 and rests on the second end 94 of the pump case 26. Small openings 86 surround the tube cap 84 so that toothpaste may flow from the cartridge 18 in the main body 12 through the tube cap 84 and onto the bristles 38. The pump spring 22 surrounds the tube cap 84.

Toothpaste dispensing commences when the user depresses the head 14 of the toothbrush 10 toward the main body 12. When the user depresses the head 14, the neck 80 engages and compresses the spring 22. Vertical ridges 88 provide support between the second end 94 of the pump case 26 and the cylindrical passage 90 so that as the head 14 is depressed, the pump case 26 does not collapse onto the cylindrical passage 90.

As the head 14 is pushed down, the neck 80, or a lower portion of the neck, engages and compresses the pump spring 22. When the head 14 is released, the spring 22 releases from its compressed state, thereby creating force against the neck 80 causing the toothpaste or liquid to be drawn from the main housing or disposable cartridge 18 into the tube or straw 56, pump system 20 neck 80, chamber or adapter 78, head 14, and dispensed through the small opening 36 in the head 14 and onto the bristles 38.

Figure 2:
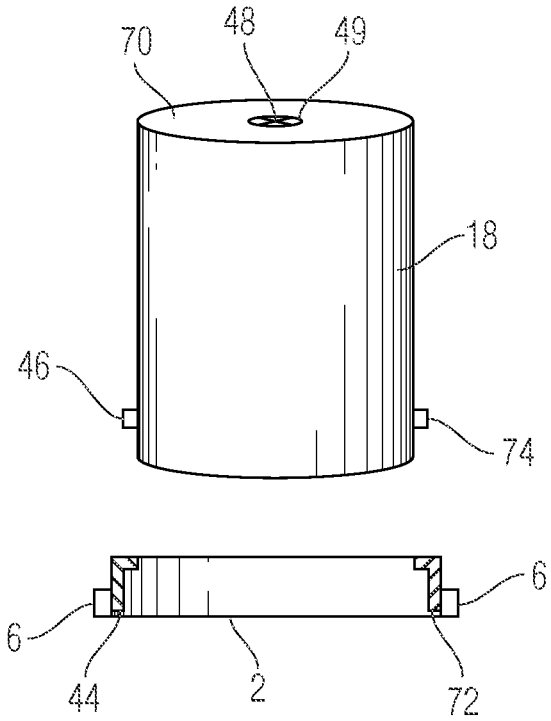
FIG. 2 illustrates the cartridge and end cap in accordance with the present invention.

Disposable cartridges 18 with toothpaste, liquid, or gel are inserted into the main body 12. As depicted in FIG. 2, the top of the disposable cartridge 18 is solid plastic 70 with the exception of a small opening 48. A pierceable seal 49 covers the small opening 48. The diameter of the small opening 48 is such that the diameter is only slightly larger than the diameter of the piercing straw 56.

The disposable cartridge 18 is inserted into the main body 12 using a snap-fit mechanism comprising two sets of mating hooks 46, 74 and recesses 44, 72. On either side of the disposable cartridge 18 are hooks 46, 74 that mate with recesses 44, 72 in an end cap 2. The hooks 46, 74 are designed such that the left hook 46 can only mate with the left recess 44 and the right hook 74 can only mate with the right recess 72. This design allows for the disposable cartridge 18 to fit in the end cap 2 in only one direction and position. The end cap 2 is then snapped onto the bottom of the toothbrush 12.

A floss department 50 is formed at the base 52 of toothbrush. The floss department 50 contains floss for the user to access. The floss department or compartment is formed at the well or base 52 of the toothbrush 10.

The end cap 2 is positioned between the main body 12 and the floss department 50. In one embodiment, the end cap 2 is attached directly to the floss department 50 so that when the end cap 2 is removed so is the floss department 50. In an alternative embodiment, the floss department 50 is detachable from the end cap 2.

As the disposable cartridge 18 is inserted into the main body 12 of the toothbrush 10, the tip 8 of the tube or straw 56 aligns with the small opening 48 on the disposable cartridge 18. The tip 8 pierces through the pierceable seal 49. Due to the mating hooks 46, 74 and recesses 44, 72, the disposable cartridge 18 is always inserted so that the small opening 48 aligns with the tip 8 of the straw 56.

Two release buttons 6 extend from the sides of the end cap 2. To release the disposable cartridge 18, both release buttons 6 must be pressed at the same time. By pressing the release button 6, the recesses, 44, 72 pulls away from the hooks 46, 74 allowing for the disposable cartridge 18 to be taken out of the end cap 2.

By way of example, a user wants to replace his disposable cartridge 18 with a new cartridge 18. The user first takes out the end cap 2 with the attached disposable cartridge 18, and presses the two release buttons 6 on either side of the end cap 2. While pressing the two release buttons 6, the user is able to take out the disposable cartridge 18 from the end cap 2. The user then takes a new disposable cartridge 18 and inserts it into the end cap 2 so that the hooks 46, 74 and recesses 72, 44 align. As the user snaps the end cap 2 to the main body 12, the tip 8 of the straw 56 pierces through the pierceable seal 49 covering the small opening 48 on the top of the disposable cartridge 18.

As an alternative to the hooks 46, 74 and recesses 44, 72, the disposable cartridge 18 may attach to the main body 12 through the use of threads independent of an end cap 2. The threads may either be positioned near the top portion of the disposable cartridge 18 or the bottom portion of the disposable cartridge 18. The threads fit matching threads positioned along the inside of the main body 12, and allow for the disposable cartridge 18 to be screwed securely into place.

In additional embodiment, threads may align the circumference of the end cap 2 so that it can be twisted onto the main body 12 of the toothbrush 10.

Figure 3:
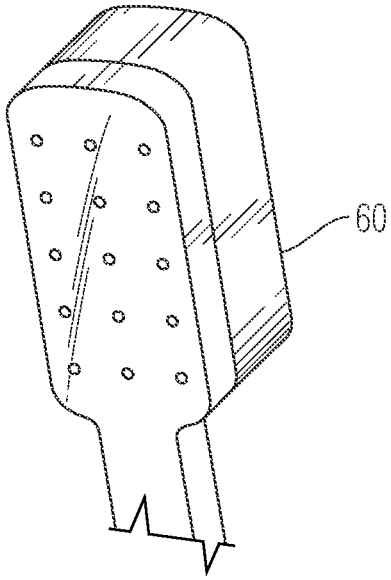
FIG. 3 illustrates a toothbrush protector to be used with the toothbrush of the present invention.

FIG. 3 illustrates a toothbrush protector 60 for protecting the head 14 of the toothbrush 10 from coming into contact with germs in the environment. The toothbrush protector 60 is designed so that it fits over the toothbrush head 14.

Figure 4:
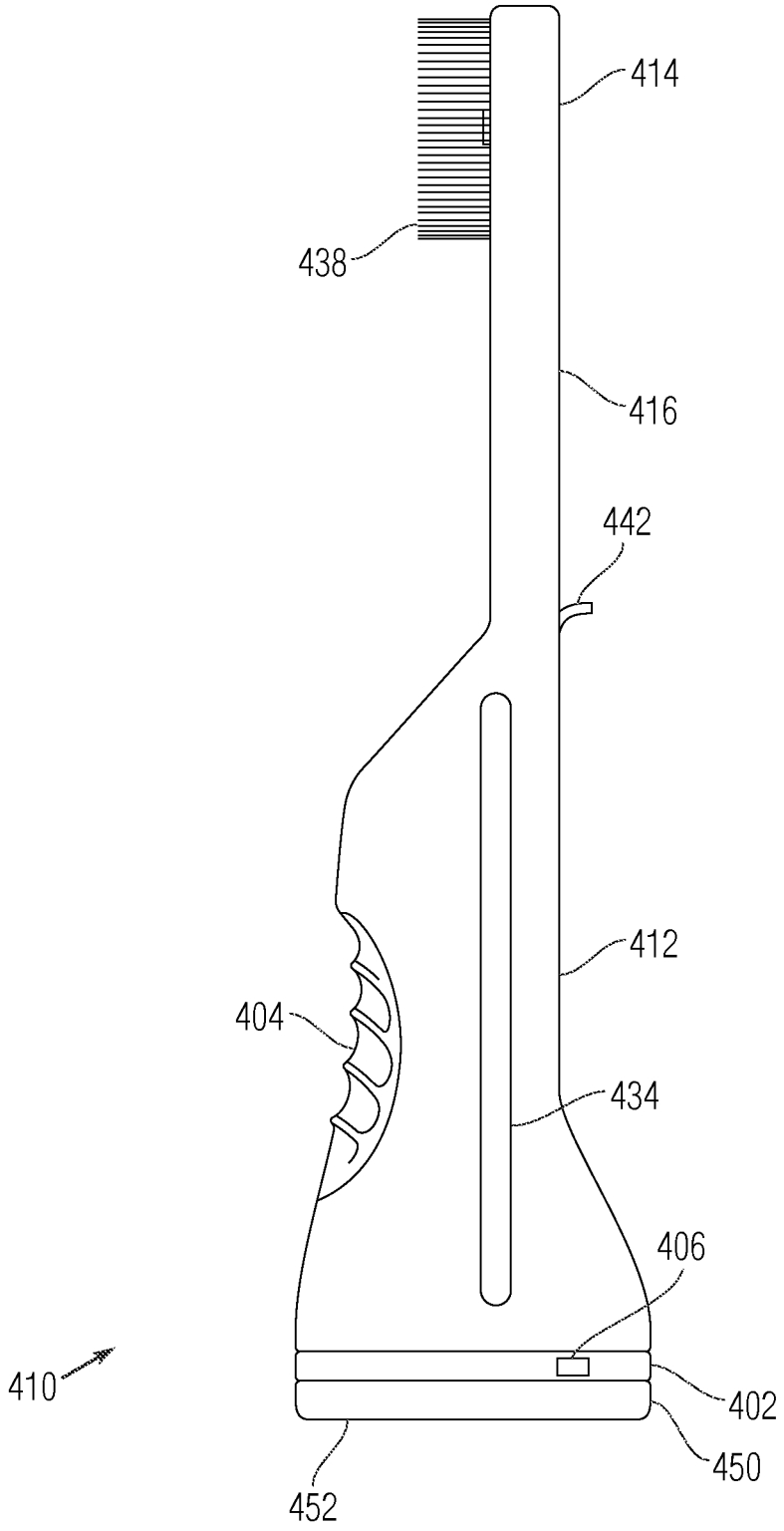
FIG. 4 illustrates a plan view of the toothbrush, in accordance with the present invention.
Figure 5:
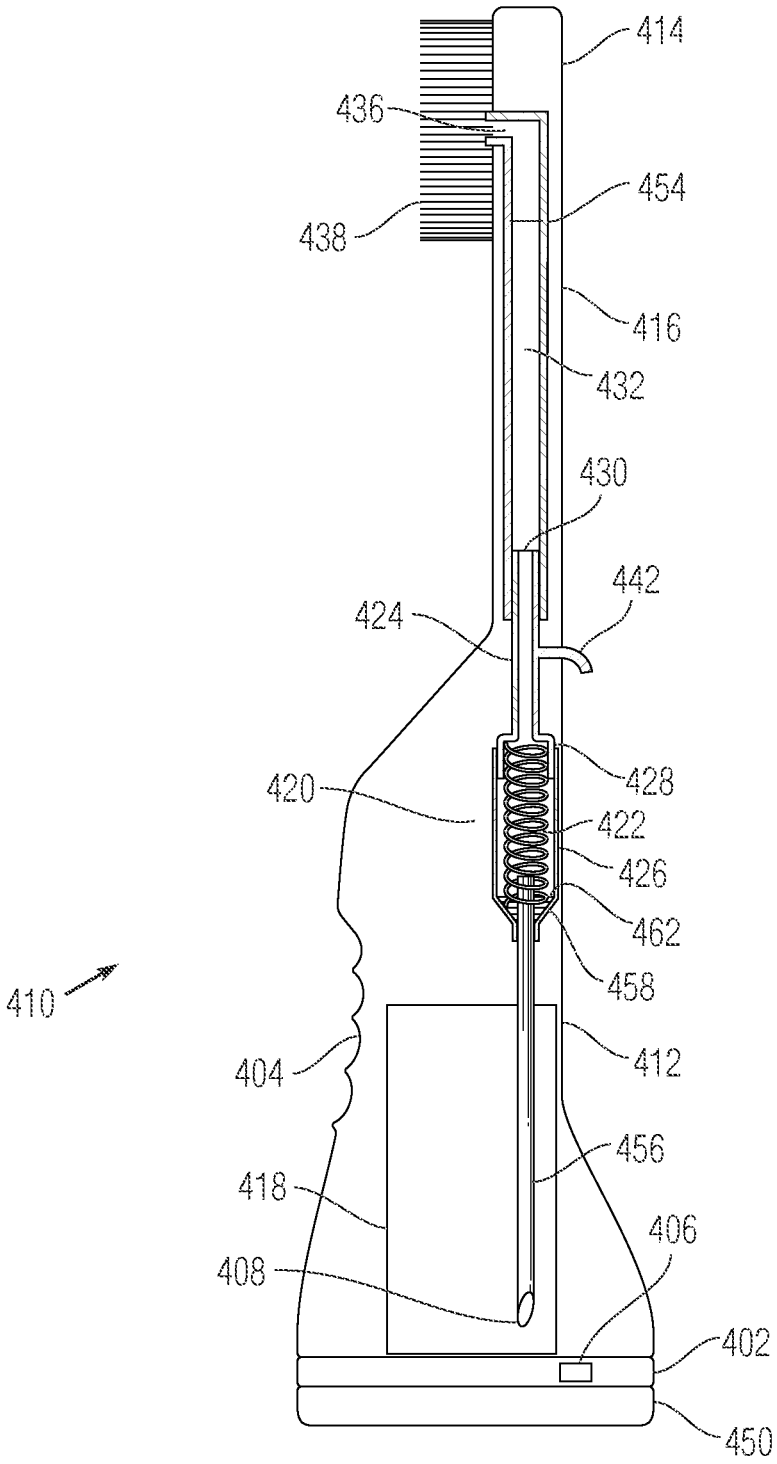
FIG. 5 illustrates an exploded view of an additional embodiment of the toothbrush of the present invention.
Figure 6:
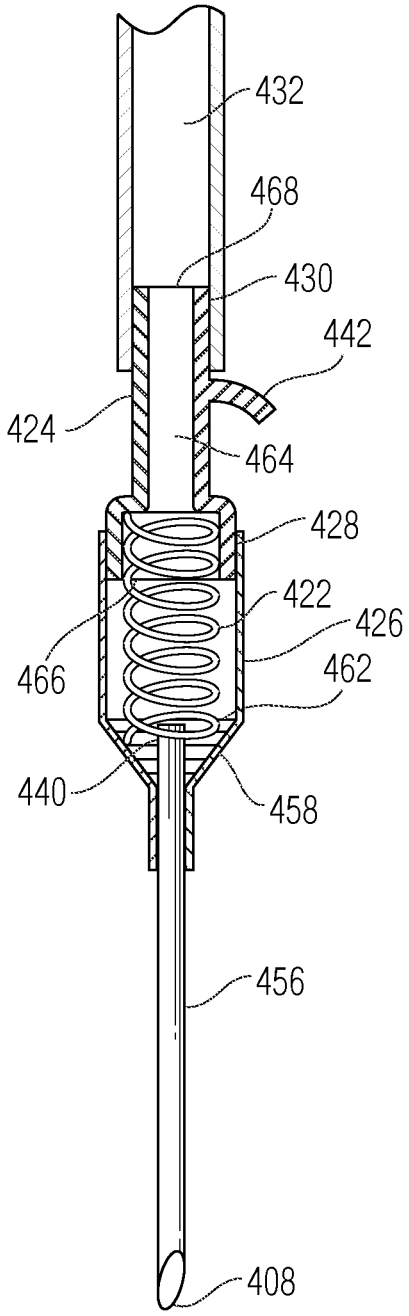
FIG. 6 illustrates an expanded view of the spring-loaded lever based pump mechanism of the present invention.

The second embodiment of present invention is described in FIGS. 4 through 6. Corresponding reference characters are used to describe corresponding elements between the first embodiment and second embodiment with the addition of a "4" on the front of such corresponding elements in the second embodiment (i.e. reference #6 in FIGS. 1 and 2 is reference #406 in FIGS. 4 and 5). Referring now to FIGS. 4 and 5, both figures illustrate a toothbrush 410 in accordance with the second embodiment of the present invention. In the second embodiment, the toothbrush 410 comprises a main body 412, a head 414, an adapter 416, a neck 424, wherein the adapter 416 and the neck 424 combine to connect the head 414 to the main body 412.

As depicted in FIG. 5, the adapter 416 has a passage 432 formed therein, enabling toothpaste to flow between the disposable cartridge 418 and head 414. The head 414 is ideally designed to be removable from the main body 412 by removing the adapter 416 from the neck 424. The adapter 416 is designed to be mechanically fastened and removable from the neck 424. The adapter 416 and neck 424 may be attached using a threaded connection, a friction fit connection, or any other logical fastening means. A one-way valve 454, located toward the top of the passage 432 in the adapter 416, prevents liquid from going back down through the passage 432 and into the main body 412. A window gage 434 (seen in FIG. 4) runs vertically along the outside of the body 412 for displaying the level of toothpaste contained in the disposable cartridge 18.

The main body 412 comprises a spring-loaded pump system 420 and a disposable cartridge 418 for storing toothpaste. The spring-loaded pump system 420 comprises a pump spring 422 which engages the lower portion of the neck 424. A pump lever 442 is attached to the neck 424 and is used for activating the pumping system 420 to move toothpaste, gel, or liquid stored in the main body 412 or disposable cartridge 418 to the opening 436. The toothpaste dispensed at opening 436 are proximate to the bristles 438 of the toothbrush head 414. It is further contemplated that the pump system 420 has compressed air contained therein. The spring-loaded pump system 420 is further described in FIG. 6.

The main body 412 further comprises a finger grip 404, configured for receiving the hand of a user, and further enabling the user to grip the body of the toothbrush. As discussed in the preferred embodiment, a floss department 450 is formed at the base 402 of toothbrush and contains floss for the user to access. A release button 406, as previously discussed in the description of the first embodiment, is provided to remove the base 402 to access the cartridge 418.

FIG. 6 depicts a detailed illustration of the spring-loaded pump mechanism 420. The pump spring 422 is positioned or encapsulated in a pump case 426. The pump case 426 includes a tapered end 458 at the bottom of the pump case 426. A first end 440 of the straw 456 partially extends into the tapered end 458 of the pump case 426. A tight seal surrounding the entry point between the straw 456 and tapered end 458 prevents fluid from escaping into the main body 412. Ridges 462 line the circumference of the tapered end 458. The pump spring 422 integrates with the ridges 462 to keep the bottom end of the pump spring 422 in place. Together the ridges 462 and tapered end 458 allows for the pump spring 422 to surround the end of the first end 440 of the straw 456 that partially extends into the tapered end 458.

The straw 456 extends from the tapered end 458 to the disposable cartridge 418. This straw 456 allows the toothpaste or liquid to travel from the disposable cartridge 418 to the spring-loaded pump 420. As depicted in FIG. 2 and as described in the preferred embodiment above, at the end of the piercing straw is a puncture piercing tip 408, such that the pointed tip 408 is able to pierce through the pierceable seal 49 on the disposable cartridge 418 (reference 18 in FIG. 2). The disposable cartridge 418 is inserted into the main body 412 of the toothbrush 410. As the disposable cartridge 418 is inserted, the tip 408 of the straw 456 aligns with the small opening 48 on the disposable cartridge 418. The tip 408 pierces through the pierceable seal 49. Mating hooks 46, 74 and recesses 44, 72 ensure the disposable cartridge 418 aligns with the straw 456. In addition, the disposable cartridges 418 can be clear such that users may use the window gage 434 (seen in FIG. 4) to determine the amount of toothpaste remaining in the cartridge 418. The disposable cartridge 18, 418 and straw 456 are further described above in FIG. 2.

The spring-loaded pump mechanism 420 further comprises a neck 424 which includes a pump lever 442. The neck 424 has a first end 428, second end 430, and pump lever 442 positioned perpendicular to the neck passage way 464 of the neck 424. The pump lever 442 has a portion which extends beyond the main body housing 412. The first or lower end 428 of the neck 424 is in contact with the pump spring 422. The second or upper end 430 is positioned within the passage 432 of the adapter 416. This allows for the second end 430 to slide in a limited range within the passage 432 as the lever 442 is depressed. A water tight seal surrounds the entry point of the second end 430 with the passage 432 to prevent fluids from leaking out of the adapter 416 and neck 424 while still allowing the second end 430 to slide.

A neck passageway 464 extends from the first end 428 to the second end 430 of the neck 424 with openings 468, 466 on each end to allow the toothpaste, liquid, or gel to travel through the pump system 420. In addition, the first end 428 is wider than the second end 430 creating a niche in the first end 428. The small tunnel 464 is also wider in the first end 428. The pump spring 422 fits within the first end 428, but not the second end 430. The lever 442 controls fluid flow (i.e. toothpaste, liquid, or gel flow) through the neck passageway 464 and passage 432 in the adapter 416.

Toothpaste dispensing commences when the user depresses the lever 442 of pumping system 420. When the user depresses the lever 442, the first end 428 of the neck 424 engages the pump spring 422. As such, the pump spring 422 compresses, thereby creating a force against the end 428 of the neck 424.

During the dispensing process, toothpaste flows from the main body 412 or the disposable cartridge 418 and through the tube or straw 458, pump system 420, neck 424, adapter 416, and there respected passages. As the pump spring 422 forces the neck 424 upward, toothpaste is moved through the passage 432, through one or more openings 436 formed in the head 414, and onto the bristles 438 of the toothbrush 410. The user would depress the lever 442 to pump the pumping system 420 to cause more paste, liquid or gel to flow through the pumping system to the openings 436. As the user removes his finger from the lever 442 the flow of toothpaste stops and the pump spring 422 extends to its natural extended position.

One or more small openings 436 connect the passage 432 in the adapter 416 of the toothbrush 410 to the toothbrush head 414. Toothpaste travels through the passage 432 in the adapter 416 and through the small openings 436 allowing for the toothpaste to be dispensed onto the bristles 438 of the toothbrush 410.

In one embodiment, the passage 432 in the adapter 416 leads to a single small opening 432 in the toothbrush head 414. In a second embodiment, the passage 432 in the adapter 416 leads to multiple small openings 432 in the toothbrush head 414. This allows the toothpaste to be evenly distributed onto the bristles 438 of the toothbrush 410.

The foregoing examples have been provided merely for the purpose of explanation and are in no way to be construed as limiting of the present method and product disclosed herein. While the invention has been described with reference to various embodiments, it is understood that the words which have been used herein are words of description and illustration, rather than words of limitation. Further, although the invention has been described herein with reference to particular means, materials, and embodiments, the invention is not intended to be limited to the particulars disclosed herein; rather, the invention expands to all functionally equivalent structures, methods and uses, such as are within the scope of the appended claims. Those skilled in the art, having the benefit of the teachings of this specification, may affect numerous modifications thereto and changes may be made without departing from the scope and spirit of the invention in its aspects.

The invention claimed is:

1. A toothbrush that dispenses fluid material, comprising:

a removable toothbrush head having a front face wherein the front face has a plurality of bristles and at least one opening, wherein the at least one opening allows for fluid material to be dispensed proximate the plurality of bristles;

an adapter for receiving the removable toothbrush head;

a neck having an upper end and a lower end, wherein the upper end is connected to the adapter and the lower end engages a fluid pumping assembly;

wherein the fluid pumping assembly is engaged by pushing a lever attached to the neck;

the fluid pumping assembly having a pump casing, a pump spring, a pump tube;

wherein the neck is configured to allow the lower end of the neck to move in and out of the pump casing;

wherein the pump casing is configured to receive the lower end of the neck; wherein the pump casing encompasses the pump spring and an upper end of the pump tube, wherein the pump casing has a lower portion which engages the pump tube;

the upper end of the pump tube configured to be inserted into the pump casing and a lower end of the pump tube extending out of the pump casing and into a main housing body, wherein the lower end of the pump tube has a tip;

the main housing body having an upper end configured to receive the fluid pumping assembly and at least a portion of the neck, and a lower end having a removable end cap;

wherein the end cap comprises an inner surface and an outer surface and the inner surface is adapted to receive a removable fluid dispensing cartridge;

wherein when fully assembled the toothbrush provides a fluid passage from the main housing through the pump tube into the pump casing, through the neck and adapter to the at least one opening in the toothbrush head.

2. The toothbrush of claim 1, wherein the adapter is configured to mechanically fasten to the upper end of the main housing body.

3. The toothbrush of claim 1, wherein the tip has a sharp end adapted to pierce a sealed opening in the fluid dispensing cartridge.

4. The toothbrush of claim 1, wherein said inner surface of the end cap includes a threaded fastening design adapted to receive a threaded design on the removable cartridge.

5. The toothbrush of claim 1, wherein said inner surface of the end cap includes a friction fit design adapted to receive the removable cartridge.

6. The toothbrush of claim 1, wherein the end cap includes a compression clamp adapted to receive the removable cartridge.

7. The toothbrush in claim 1, wherein the end cap comprises an outer surface and the outer surface is adapted to receive a dental floss holder.

8. A toothbrush that dispenses fluid material, comprising:

a removable toothbrush head having a front face wherein the front face has a plurality of bristles and at least one opening, wherein the at least one opening allows for fluid material to be dispensed proximate the plurality of bristles;

an adapter for receiving the removable toothbrush head;

a neck having an upper end and a lower end, wherein the upper end is connected to the adapter and the lower end engages a fluid pumping assembly;

wherein the fluid pumping assembly is engaged by pushing a lever attached to the neck;

the fluid pumping assembly having a pump casing, a pump spring, and a pump tube;

wherein the neck is configured to allow the lower end of the neck to move in and out of the pump casing;

wherein the pump casing is configured to receive the lower end of the neck; wherein the pump casing encompasses the pump spring and an upper end of the pump tube, wherein the pump casing has a lower portion which engages the pump tube;

the upper end of the pump tube configured to be inserted into the pump casing and a lower end of the pump tube extending out of the pump casing and into a main housing body, wherein the lower end of the pump tube has a tip;

the main housing body having an upper end configured to receive the fluid pumping assembly and at least a portion of the neck, and a lower end having a removable end cap; wherein when fully assembled the toothbrush provides a fluid passage from the main housing through the pump tube into the pump casing, through the neck and adapter to the at least one opening in the toothbrush head;

wherein the toothbrush is adapted to pump fluid from within the main housing body to the at least one opening by pushing the lever on the pump assembly up and down which moves the neck in and out of the pump case to create the pumping action;

wherein the end cap comprises an inner surface and an outer surface and the inner surface is adapted to receive a removable fluid dispensing cartridge and the outer surface is adapted to mechanically receive a dental floss holder; and wherein the tip has a sharp point adapted to pierce a sealed opening in the fluid dispensing cartridge.

9. The toothbrush in claim 8, wherein the lower portion of the pump casing comprises a tapered end with ridges that line the outer circumference of the tapered end of the pump case.

10. The toothbrush of claim 8, wherein inner surface of the end cap includes a threaded fastening design adapted to receive the removable cartridge.

11. The toothbrush of claim 8, wherein inner surface of the end cap includes a friction fit design adapted to receive the removable cartridge.

12. The toothbrush of claim 8, wherein the end cap includes a compression clamp adapted to receive the removable cartridge.

* * * * *